US009796569B2

(12) United States Patent
Katerberg et al.

(10) Patent No.: US 9,796,569 B2
(45) Date of Patent: Oct. 24, 2017

(54) LINEAR MOTION LINKAGE ASSEMBLY FOR AUTOMOTIVE LIFT

(71) Applicant: VEHICLE SERVICE GROUP, LLC, Madison, IN (US)

(72) Inventors: Kevin S. Katerberg, Madison, IN (US); Bryan Taylor, Columbus, IN (US)

(73) Assignee: Vehicle Service Group, LLC, Madison, IN (US)

( * ) Notice: Subject to any disclaimer, the term of this patent is extended or adjusted under 35 U.S.C. 154(b) by 156 days.

(21) Appl. No.: 14/814,596

(22) Filed: Jul. 31, 2015

(65) Prior Publication Data

US 2016/0039647 A1 Feb. 11, 2016

Related U.S. Application Data

(60) Provisional application No. 62/033,867, filed on Aug. 6, 2014.

(51) Int. Cl.
*B66F 3/00* (2006.01)
*B66F 7/28* (2006.01)
(Continued)

(52) U.S. Cl.
CPC ..... *B66F 7/28* (2013.01); *B66F 7/0691* (2013.01); *B66F 7/08* (2013.01); *B66F 7/20* (2013.01)

(58) Field of Classification Search
CPC ..... B66F 3/04; B66F 5/00; B66F 5/04; B66F 7/00; B66F 7/04; B66F 7/065; B66F 7/0691
See application file for complete search history.

(56) References Cited

U.S. PATENT DOCUMENTS 5,016,858 A 5/1991 Mitchell
5,096,159 A 3/1992 Fletcher
(Continued)

FOREIGN PATENT DOCUMENTS

CN 201761635 U 3/2011
EP 0878437 A1 11/1998
KR 10-0220552 B1 10/1999

OTHER PUBLICATIONS

International Search Report and Written Opinion dated Oct. 19, 2015 for Application No. PCT/US2015/043038.

*Primary Examiner* — Lee D Wilson
(74) *Attorney, Agent, or Firm* — Frost Brown Todd LLC

(57) ABSTRACT

An apparatus for lifting vehicles includes a runway, a base, an actuation assembly, a first armature assembly, a second armature assembly, and a third armature assembly. The runway is designed to vertically lift a vehicle from a lowered position to a raised position. The runway is connected to the third armature assembly. In turn, the third armature assembly is connected to the actuation assembly, which is pivotally fixed to the base. The first and second armature assemblies also connect the base with the third armature assembly. The actuation assembly is configured to lift the third armature assembly, which is guided by both the first armature assembly and second armature assembly. In response to the actuation assembly, the third armature assembly then forces the runway from the lowered position to the raised position, thereby lifting the vehicle.

20 Claims, 13 Drawing Sheets

(51) Int. Cl.

| | |
|---|---|
| ***B66F 7/20*** | (2006.01) |
| ***B66F 7/06*** | (2006.01) |
| ***B66F 7/08*** | (2006.01) |

(56) References Cited

U.S. PATENT DOCUMENTS

| | | | | |
|---|---|---|---|---|
| 5,190,122 | A | 3/1993 | Fletcher et al. | |
| 5,199,686 | A | 4/1993 | Fletcher | |
| 6,059,263 | A | 5/2000 | Otema et al. | |
| 6,269,676 | B1 | 8/2001 | Soyk | |
| 6,484,554 | B2 | 11/2002 | Soyk | |
| 6,601,430 | B2 | 8/2003 | McClellan | |
| 6,763,916 | B2 | 7/2004 | Green et al. | |
| 6,983,196 | B2 | 1/2006 | Green et al. | |
| 8,052,122 | B2 * | 11/2011 | Rossato | B66F 7/0641 254/10 C |
| 8,286,944 | B2 * | 10/2012 | Rossato | B66F 7/0633 254/122 |
| 2009/0020736 | A1 * | 1/2009 | Rossato | B66F 7/0641 254/90 |
| 2012/0048653 | A1 | 3/2012 | Matthews et al. | |
| 2012/0168701 | A1 * | 7/2012 | Rossato | B66F 7/0633 254/89 H |
| 2016/0039647 | A1 * | 2/2016 | Katerberg | B66F 7/20 254/93 L |

* cited by examiner

150

LINEAR MOTION LINKAGE ASSEMBLY FOR AUTOMOTIVE LIFT

PRIORITY

This application claims priority to U.S. Provisional Patent App. No. 62/033,867, entitled "Linear Motion Linkage Assembly for Automotive Lift," filed Aug. 6, 2014, the disclosure of which is incorporated by reference herein.

BACKGROUND

A vehicle lift is a device operable to lift a vehicle such as a car, truck, bus, etc. Some vehicle lifts operate by positioning two runways at, or near, a shop floor level. The vehicle may be then driven or rolled onto the runways, allowing the runways to support the vehicle. The underside of each runway may be attached to a plurality of powered or manually actuated lifting assemblies. The lifting assemblies may be actuated to raise the runways and the vehicle to a desired height. Afterward, the vehicle may then be lowered once the user has completed his or her task requiring the vehicle lift. In some cases, the lifting assemblies may comprise a single elongated member which may rotate relative to the floor to pivot the runways upwardly. In other cases, the lifting assemblies may comprise a plurality of linkages which pivot relative to one another to cause the runways to rise upwardly, similar to a pair of scissors.

Examples of vehicle lift devices and related concepts are disclosed in U.S. Pat. No. 6,983,196, entitled "Electronically Controlled Vehicle Lift and Vehicle Services System," issued Jan. 3, 2006, the disclosure of which is incorporated by reference herein; U.S. Pat. No. 6,763,916, entitled "Method and Apparatus for Synchronizing a Vehicle Lift," issued Jul. 20, 2004, the disclosure of which is incorporated by reference herein; U.S. Pat. No. 6,601,430, entitled "Jack with Elevatable Platform," issued Aug. 5, 2003, the disclosure of which is incorporated by reference herein; U.S. Pat. No. 6,484,554, entitled "Portable Lift and Straightening Platform," issued Nov. 26, 2002, the disclosure of which is incorporated by reference herein; U.S. Pat. No. 6,269,676, entitled "Portable Lift and Straightening Platform," issued Aug. 7, 2001, the disclosure of which is incorporated by reference herein; U.S. Pat. No. 6,059,263, entitled "Automotive Alignment Lift," issued May 9, 2000, the disclosure of which is incorporated by reference herein; U.S. Pat. No. 5,199,686, entitled "Non-Continuous Base Ground Level Automotive Lift System," issued Apr. 6, 1993, the disclosure of which is incorporated by reference herein; U.S. Pat. No. 5,190,122, entitled "Safety Interlock System," issued Mar. 2, 1993, the disclosure of which is incorporated by reference herein; U.S. Pat. No. 5,096,159, entitled "Automotive Lift System," issued Mar. 17, 1992, the disclosure of which is incorporated by reference herein; and U.S. Pub. No. 2012/0048653, entitled "Multi-Link Automotive Alignment Lift," published Mar. 1, 2012, the disclosure of which is incorporated by reference herein.

While a variety of vehicle lifts have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
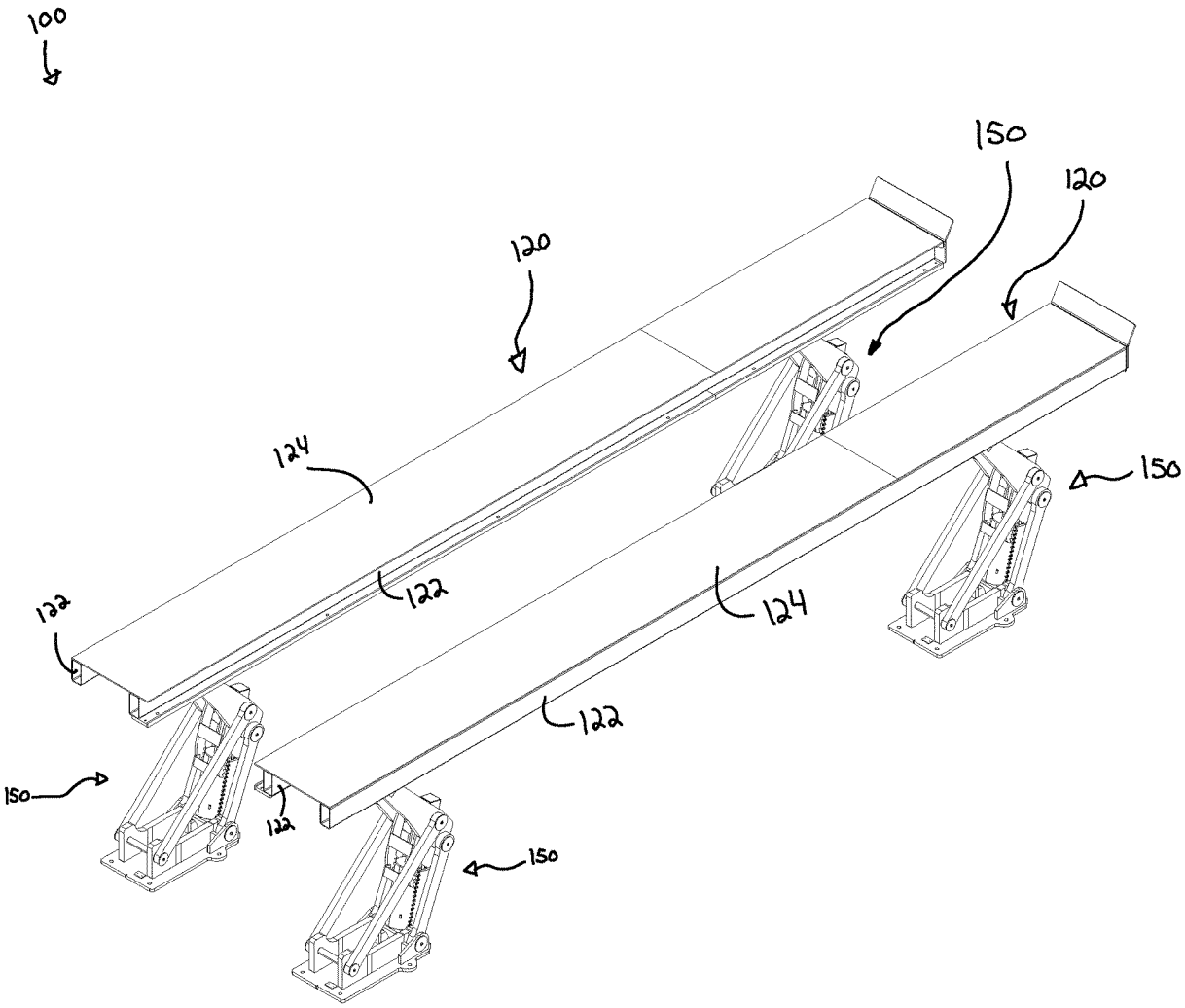
FIG. 1 depicts a perspective view of an exemplary vehicle lift.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

FIG. 1 shows a perspective view of vehicle lift system (100) in a raised position. Vehicle lift system (100) comprises two runways (120) and four lift assemblies (150). Runways (120) are generally rectangular in shape, extending from one lift assembly (150) to another. Each runway (120) comprises two longitudinally extending side rails (122) and a relatively flat top plate (124). Side rails (122) are comprised of any suitable rigid material, such as steel, iron, aluminum, composites, etc. Although side rails (122) are shown as having a generally rectangular construction, it should be understood that side rails (122) may have any suitable cross-sectional geometry such as square, round, I-shaped, L-shaped, Z-shaped, or the like.

Top plate (124) is secured to the top of side rails (122) by any suitable means such as welding, mechanical fastening, adhesive boding, etc. In the present example, top plate (124) is comprised of a thin sheet of a rigid material such as steel, iron, aluminum, composite, or the like. Top plate (124) is configured to support the load of a vehicle resting on runways (120). The load of a vehicle is also distributed by top plate (124) to runways (120), which provide additional structural rigidity.

Each runway (120) is positioned relative to the other a transverse distance that is approximately equivalent to the wheel track of a vehicle that is desired to be lifted. The transverse distance thus permits a vehicle's wheels to rest on top of runways (120). In some examples, runways (120) may include angled sloped ramps (not shown) or other features to facilitate rolling or driving a vehicle onto runways (120). Of course, such a feature is entirely optional and may be omitted in other examples. Runways (120) may also include other features suitable to support a vehicle as will be apparent to one of ordinary skill in the art in view of the teachings herein. Some examples of additional and/or alternative features that may be incorporated into runways (120) and/or other features of lift system (100) are disclosed in U.S. Pat. No. 6,763,916, entitled "Method and Apparatus for Synchronizing a Vehicle Lift," issued Jul. 20, 2004, the disclosure of which is incorporated by reference herein; U.S. Pat. No. 6,059,263, entitled "Automotive Alignment Lift," issued May 9, 2000, the disclosure of which is incorporated by reference herein; U.S. Pat. No. 5,199,686, entitled "Non-Continuous Base Ground Level Automotive Lift System," issued Apr. 6, 1993, the disclosure of which is incorporated by reference herein; U.S. Pat. No. 5,190,122, entitled "Safety Interlock System," issued Mar. 2, 1993, the disclosure of which is incorporated by reference herein; U.S. Pat. No. 5,096,159, entitled "Automotive Lift System," issued Mar. 17, 1992, the disclosure of which is incorporated by reference herein; and U.S. Pub. No. 2012/0048653, entitled "Multi-Link Automotive Alignment Lift," published Mar. 1, 2012, the disclosure of which is incorporated by reference herein. It should be understood that that the teachings below may be readily combined with the teachings of the various references cited herein.

Figure 2:
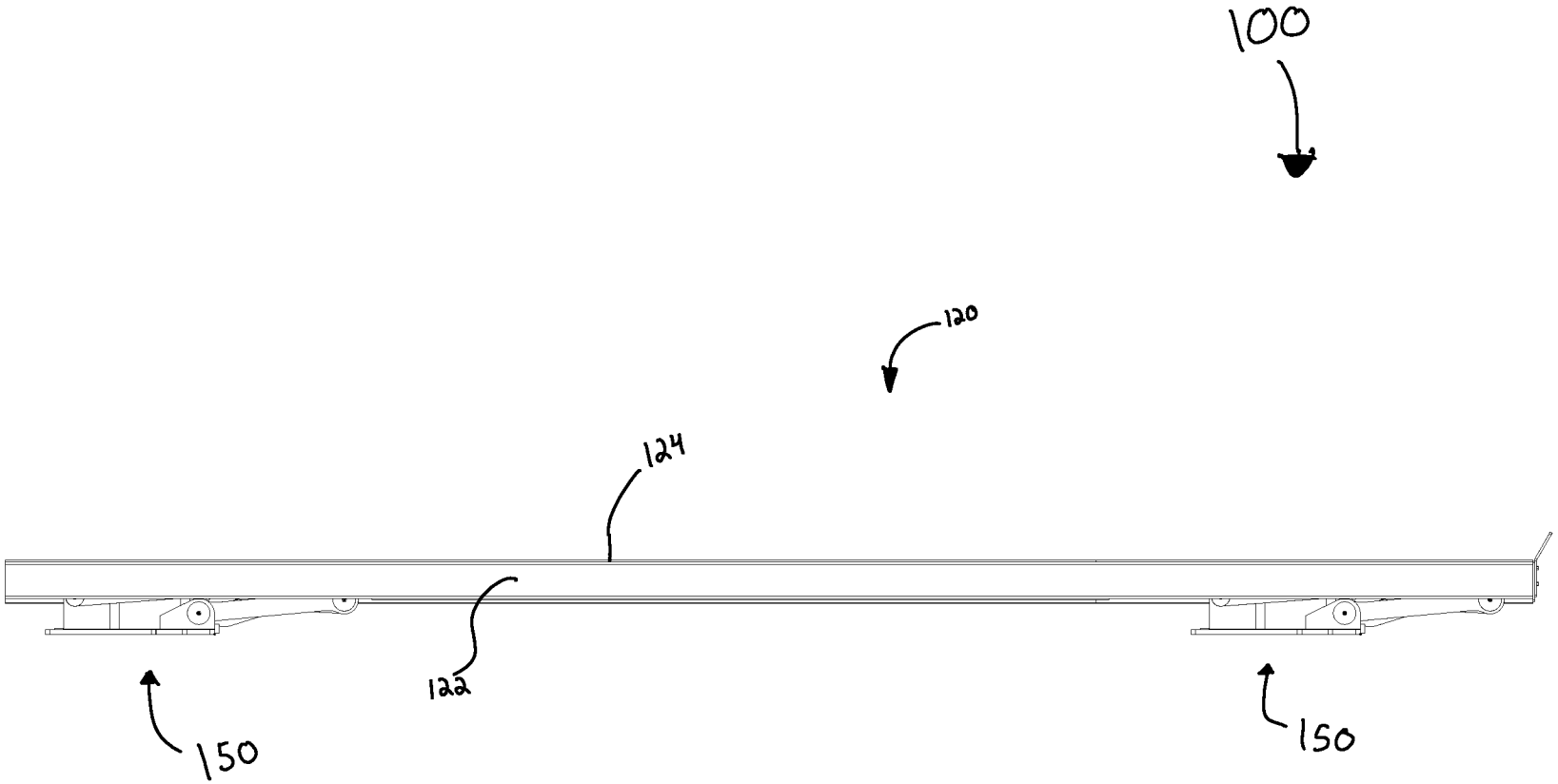
FIG. 2 depicts a side elevational view of the vehicle lift of FIG. 1 in a retracted position.
Figure 3:
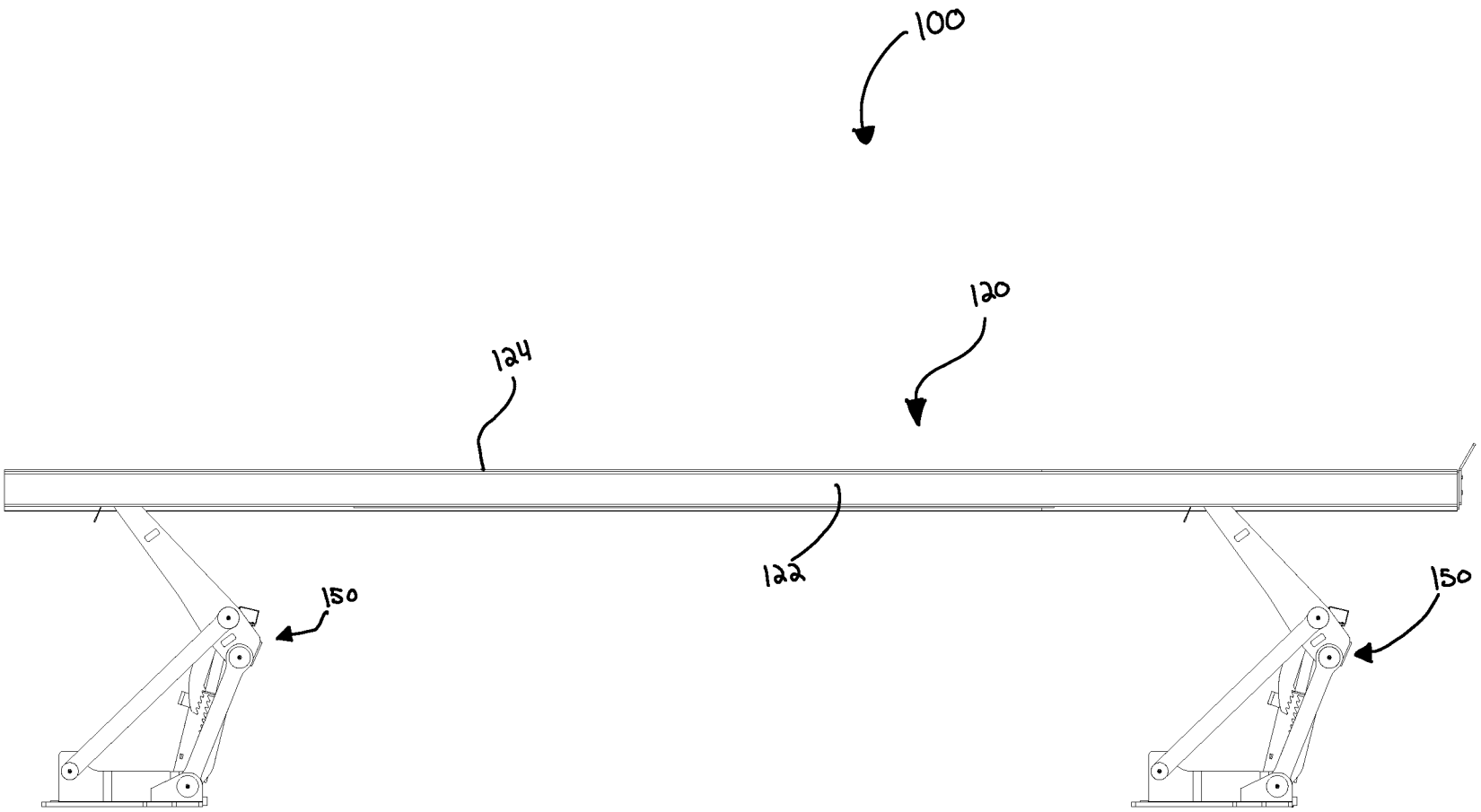
FIG. 3 depicts a side elevational view of the vehicle lift of FIG. 1 in an extended position.

As can be seen in FIGS. 2-3, and as will be discussed in greater detail below, vehicle lift (100), via runways (120) and lift assemblies (150), is operable to lift a vehicle vertically from a height approximately even with a shop floor to a desired working height. As will be understood, lift assemblies (150) are operable to lift runways (120) with substantially vertical movement of runways (120).

Figure 4:
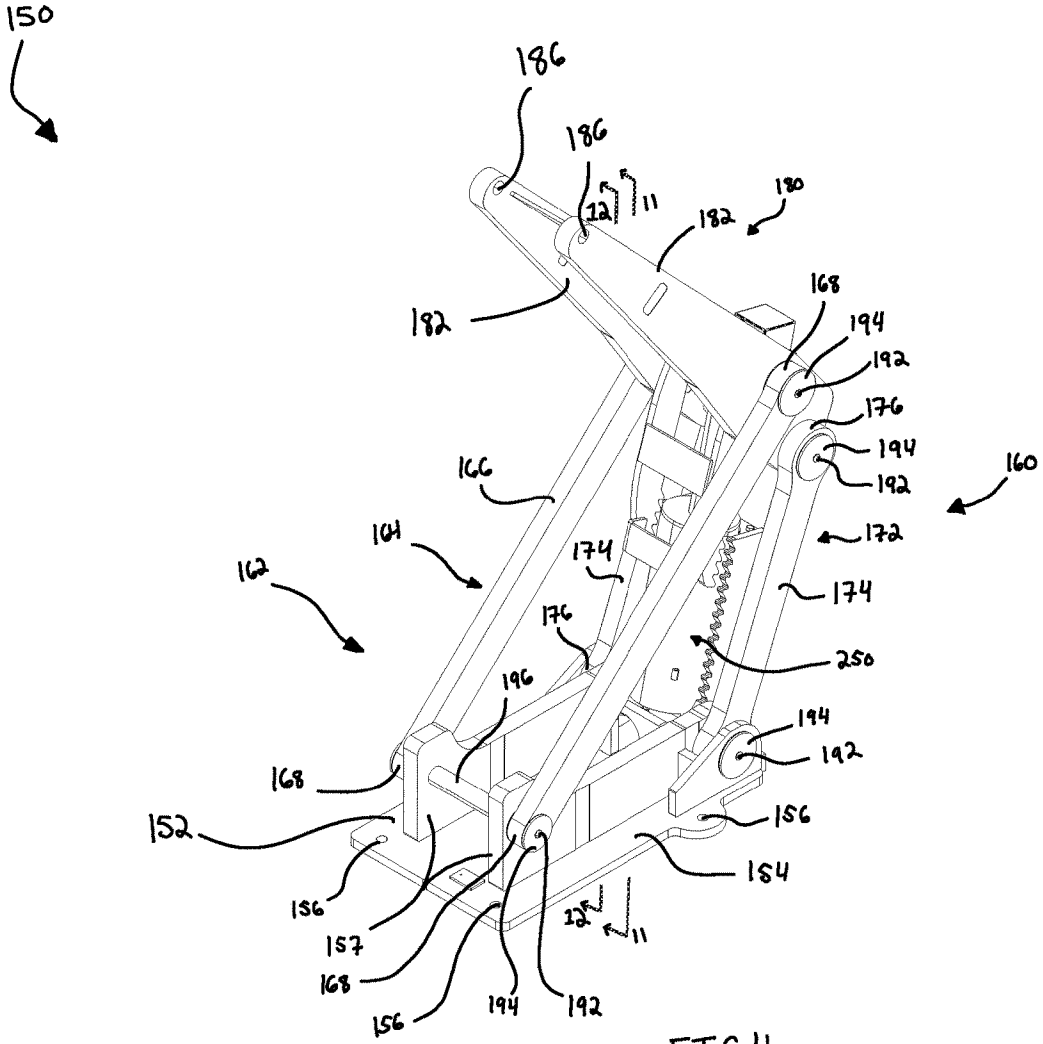
FIG. 4 depicts a perspective view of a lift assembly of the vehicle lift of FIG. 1 with the lift assembly in an extended position.
Figure 5:
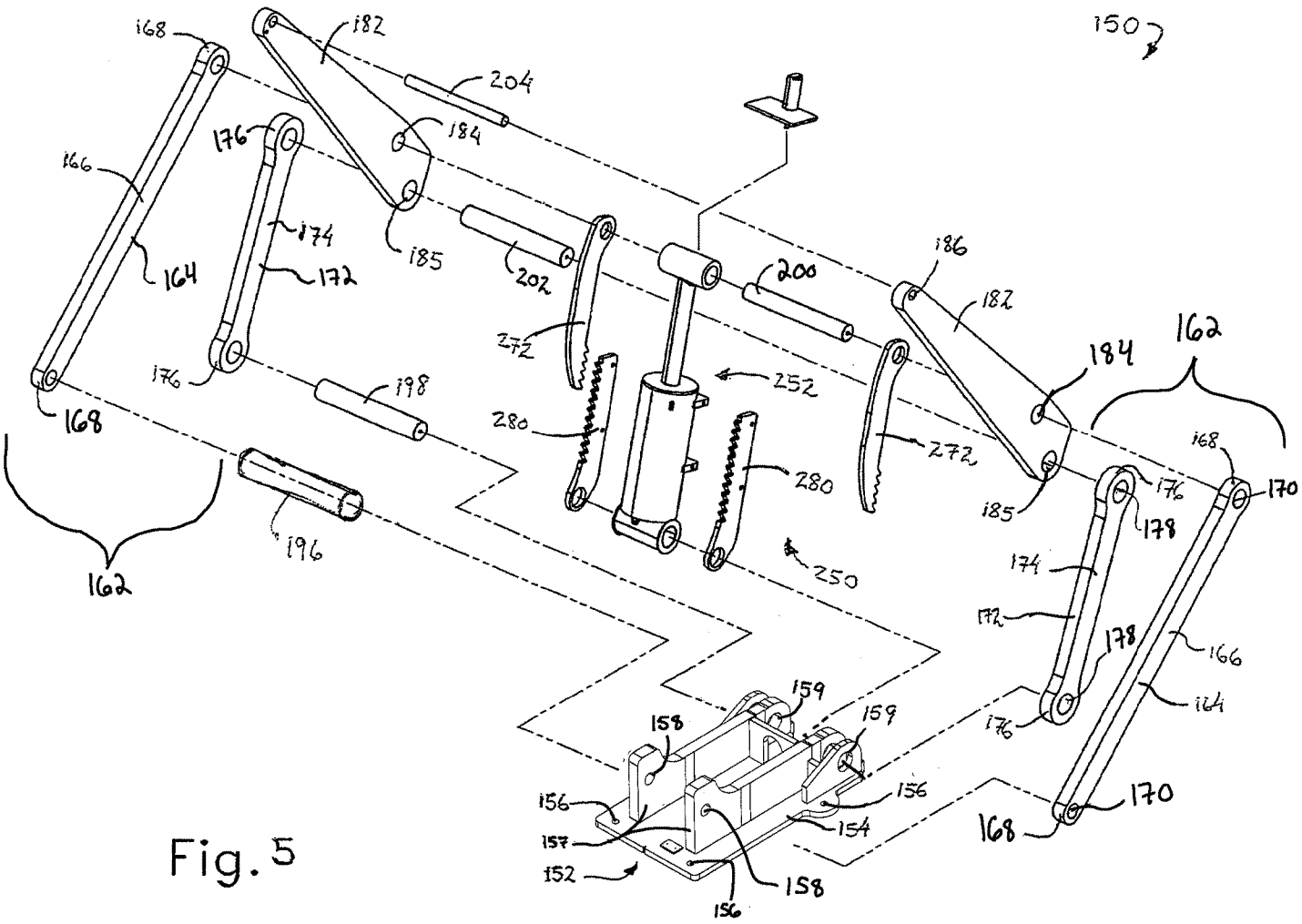
FIG. 5 depicts an exploded perspective view of the lift assembly of FIG. 4

FIG. 4 shows a perspective view of lift assembly (150) while FIG. 5 shows an exploded view of lift assembly (150). Lift assembly (150) comprises a base (152), a linkage assembly (160), and an actuation assembly (250). Base (152) comprises a generally rectangular base plate (154) and two mounting brackets (157). Base plate (154) may be comprised of a rigid material such as steel, iron, aluminum, composite, or the like. Base plate (154) is shown as having a plurality of mounting holes (156). In the present example, mounting holes (156) may be used to receive bolts and/or other anchors to mount base plate (154) to a shop floor, thus providing a fixed platform for lifting assembly (150). In other examples, mounting holes (156) may be omitted entirely and base plate (154) may be secured to a shop floor by some other means such as welding, adhesive bonding, mechanical fastening, etc. Yet in other examples, mounting holes (156) may be used to secure lift assembly (150) to another surface such as a portable rack for vehicle lift systems (100) designed for smaller vehicles.

Mounting brackets (157) extend vertically from base plate (154). Mounting brackets (157) may be fixedly secured to base plate (154) by any suitable means such as welding, adhesive bonding, mechanical fastening, and/or the like. Alternatively, mounting brackets (157) may be integral to base plate (154). As can best be seen in FIG. 5, each mounting bracket (157) comprises a pair of mounting holes (158, 159). As will be described in greater detail below, components of linkage assembly (160) and actuation assembly (250) are rotatbly coupled to mounting brackets (157).

Mounting holes (158, 159) are positioned at each end of mounting bracket (157). In particular, a rear mounting hole (158) is positioned near the rear of mounting bracket (157) and a front mounting hole (159) is positioned near the front of mounting bracket (157). Rear mounting hole (158) is positioned vertically higher than front mounting hole (159). As will be understood in view of the description below, mounting holes (158, 159) are oriented such that linkage assembly (160) and actuation assembly (250) are operable to fold up thus minimizing the height of vehicle lift system (100) when vehicle lift system (100) is in the retracted position as shown in FIG. 2. Accordingly, the shape of mounting brackets (157) is configured to arrange mounting holes (158, 159) in the positioning described above. Thus, although mounting brackets (157) are shown as having a particular shape, mounting brackets (157) may be of any suitable shape as will be apparent to those of ordinary skill in the art in view of the teachings herein.

Linkage assembly (160) comprises a set of four lower links (162) and a pair of third armatures (182). Lower links (162) comprise a pair of first armatures (164) and a pair of second armatures (172). First armatures (164) are generally similar having the same size and shape, and comprising an elongated portion (166) positioned between two rounded end portions (168). Similarly, second armatures (172) are generally similar having the same size and shape, and comprising an elongated portion (174) positioned between two rounded end portions (176). Although they are differing in shape, the rounded end portions (168, 176) of lower links (162) each comprise bores (170, 178) which permit first and second pair of armatures (164, 172) to be respectively attached to pins (196, 198) associated with mounting brackets (157), at one end, and pins (200, 202) associated with third armatures (182), at another end. It should be noted, that each pair of rounded end portions (168, 176) do not require equal dimensions.

As can be seen in FIG. 4, first armatures (164) are generally longer in length relative to second armatures (172). As will be described in greater detail below, the longer length of first armatures (164) relative to second armatures (172) is generally necessitated by the configuration of linkage assembly (160). Although lower links (162) are shown as having a certain length, it should be understood that their lengths may be varied depending on the design specifications of vehicle lift system (100). For instance, some vehicle lift systems (100) may be designed to have a higher or lower working height. Thus, longer or shorter lower links (162) may be required to increase or decrease the range of motion of lift assembly (150), respectively.

Elongated portions (166, 174) of lower links (162) are generally rectangular in shape. Alternatively, any suitable shape may be used, such as an elongated rod, elongated hexagon, hollow tubing, or the like. Rounded end portions (168, 176) are generally circular to accommodate bores (170, 178) and generally reduce the area occupied by rounded end portions (168, 176). In other examples rounded end portions (168, 176) may be comprised of any suitable shape. Lower links (162) are relatively rigid and may be comprised of any suitable material such as steel, iron, aluminum, composite, or the like. Of course, lower links (162) may have any other suitable configuration as will be apparent to those of ordinary skill in the art in view of the teachings herein.

Third armatures (182) are generally the same size and shape. In particular, each third armature (182) is approximately rectangular and includes a taper from one end to another. The front end of third armature (182) is wider relative to the rear end to accommodate two connecting bores (184, 185). As will be described in greater detail below, upper connecting bore (184) and lower connecting bore (185) are used to rotatably couple lower links (162) to third armatures (182) via pins (200, 202) respectively. As will also be described in greater detail below, connecting bores (184, 185) are positioned on third armature (182) to provide pivot points about which lower links (162) may pivot relative to third armature (182). The rear end of third armature (182) is rounded and includes an attachment bore (186). As will be described in greater detail below, attachment bore (186) is positioned to permit rotatable coupling between third armature (182) and runway (120) via pin (204) and pin blocks (190).

As can best be seen in FIG. 5, lift assembly (150) includes a plurality of pins (196, 198, 200, 202) which rotatably couple various components of lift assembly (150). In particular, bore (170) of the lower portion of first armatures (164) is rotatably coupled to rear mounting holes (158) of mounting brackets (157) via pin (196). Pin (196) may be welded or fixed to mounting bracket (157) of base (152) by any suitable methods as will be apparent to one of ordinary skill in the art in view of the teachings herein. Bore (170) of the lower portion of second armatures (172) is rotatably coupled to front mounting holes (159) of mounting brackets (157) via pin (198). Pin (198) may be welded or fixed to mounting bracket (157) of base (152) by any suitable methods as will be apparent to one of ordinary skill in the art in view of the teachings herein. Alternatively, pin (198) may rotate freely relative to mounting bracket (157). As will be described in greater detail below, pin (198) at this joint also rotatably couples to actuation assembly (250). Similarly, another pin (200) provides rotatable coupling between upper connecting bore (184) of third armatures (182), bores (170) of the upper portions of first armatures (164), and sleeve (262). Finally, bores (178) of the upper portions of second armatures (172) are rotatably coupled to lower connecting bore (185) of third armatures (182) via pin (202). Pin (202) may be welded or fixed to third armatures (182) by any suitable methods as will be apparent to one of ordinary skill in the art in view of the teachings herein. Pins (196, 198, 200, 202) are shown as being fastened to their respective mating parts using bolts (192) and washers (194). Of course, pins (196, 198, 200, 202) may be fastened to their respective mating parts by any other suitable means. Although not shown, it should be understood that the various joints described above may also include bushings, bearings, or other devices suitable to reduce friction between the various parts.

Figure 6:
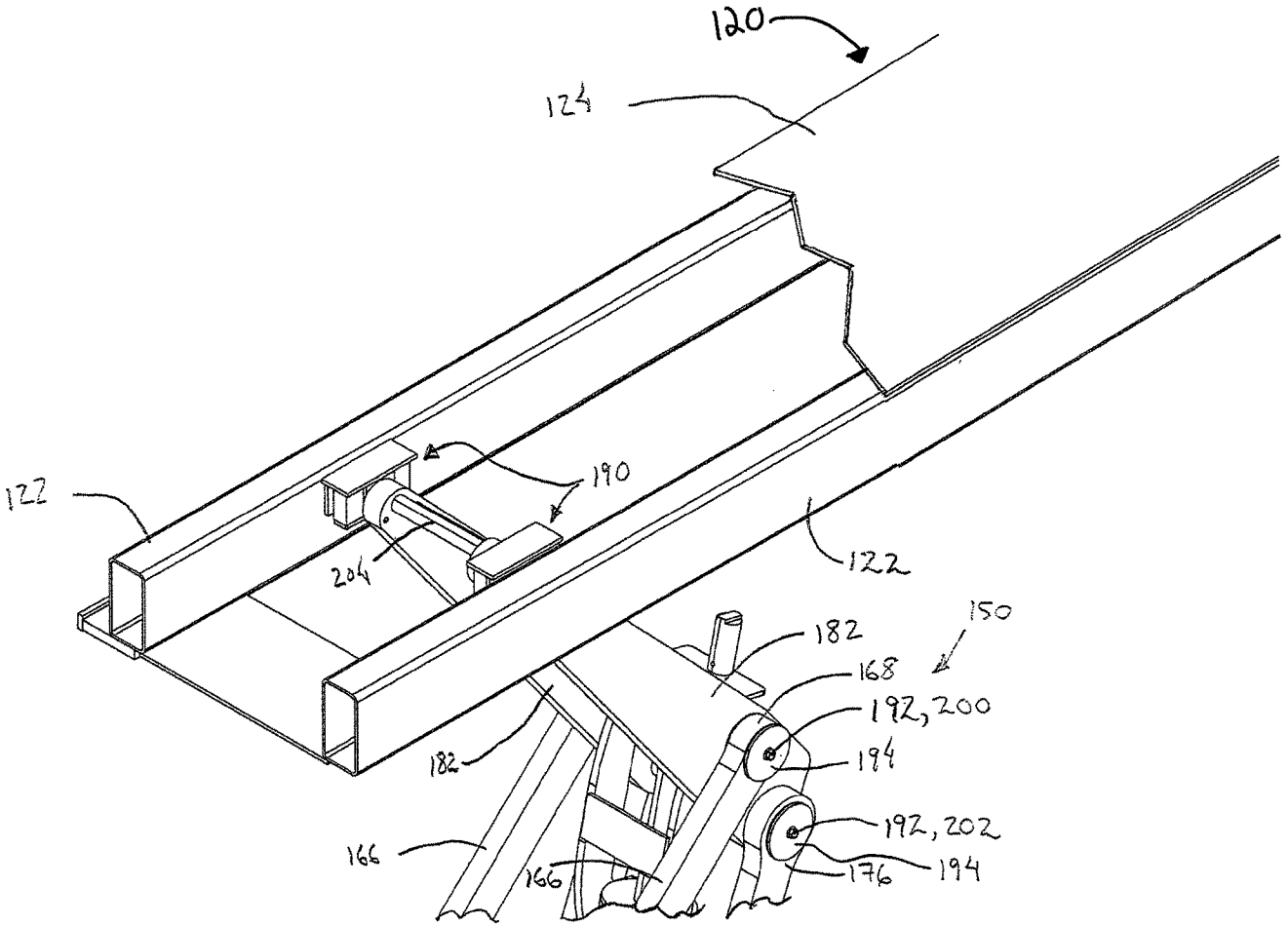
FIG. 6 depicts a perspective cut-away view of the lift assembly of FIG. 4, with a portion of the lift assembly cut-away to show an attachment assembly.

FIG. 6 shows a cutaway view of runway (120) such that pin blocks (190) between third armatures (182) and runway (120) are visible. As can be seen, attachment bores (186) of third armatures (182) are rotatably coupled to pin blocks (190) via pin (204). Pin (204) may be welded or fixed to third armatures (182) by any suitable methods as will be apparent to one of ordinary skill in the art in view of the teachings herein. Pin blocks (190) are fixedly secured to runway (120) such that third armatures (182) are pivotably fixed at a single location relative to runway (120). In other words, Pin blocks (190) (190) do not slide along runway (120). It should be understood that while pin blocks (190) are shown as coupling with third armatures (182), pin blcoks (190) could alternatively be used to couple with lower links (162). In other words, on other examples lift assembly (150) may be essentially turned upside down and be operated with lower links (162) rotatably coupling to runway (120) and third armatures rotatably coupling to base (152). Like with other joints discussed above, the joint between third armatures (182) and pin blocks (190) may include other devices suitable to reduce friction such as bushings, bearings, washers, etc.

FIGS. 7-10 show linkage assembly (160) and base (152) in an exemplary mode of operation as the linkage assembly (160) transitions from the retracted position to an extended position. It should be understood that the combination of mounting brackets (157), lower links (162), and third armatures (182) forms a four bar linkage such that rotation of lower links (162) is operable to produce substantially vertical motion of attachment bore (186) of third armatures (182).

Figure 7:
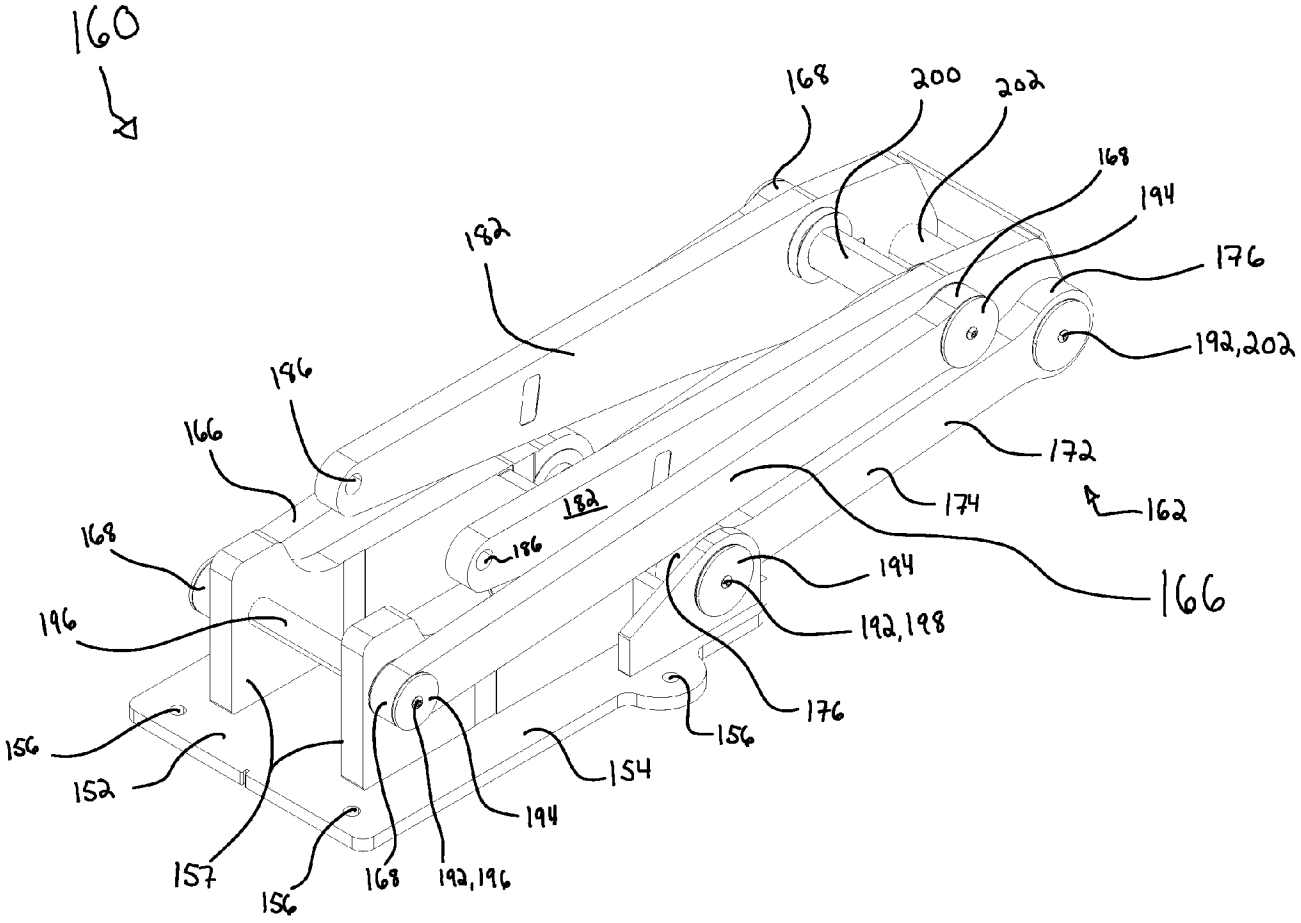
FIG. 7 depicts a perspective view of the lift assembly of FIG. 4 with the actuation assembly omitted, with the lift assembly in a retracted position.
Figure 8:
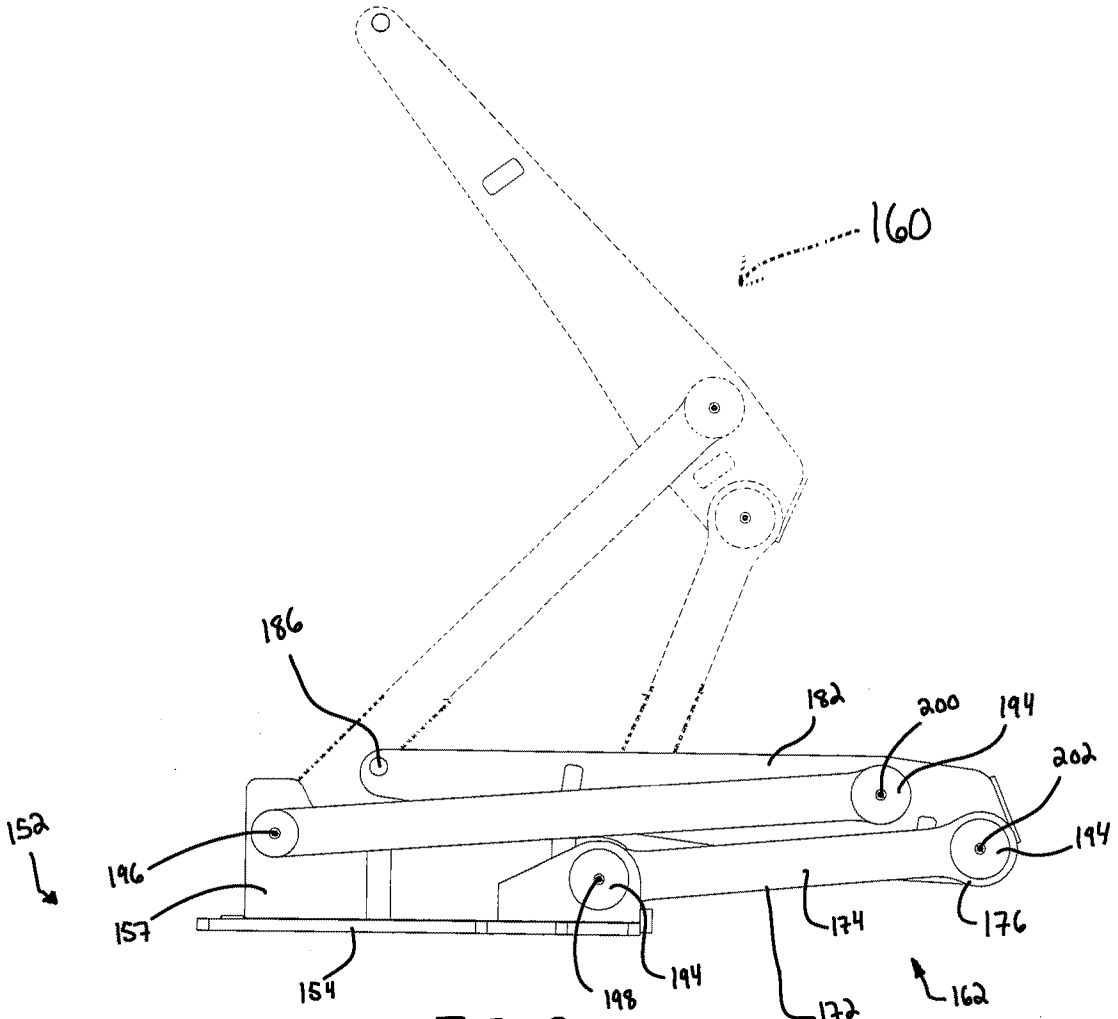
FIG. 8 depicts a side elevational view of a linkage assembly of the lift assembly of FIG. 4, with the linkage assembly in a retracted position.

FIGS. 7 and 8, show linkage assembly (160) in the retracted position. As can be seen, lower links (162) and third armatures (182) are configured to fold relative to each other so that they lower links (162) and third armatures (182) have limited vertical extension. Accordingly, when linkage assembly (160) is in the retracted position, runway (120) is relatively close to ground level. Additionally, in the retracted position, lower links (162) and third armatures (182) are nearly parallel with each other. In FIG. 8, phantom lines show linkage assembly (160) in the extended position to show the relative difference between the extended and retracted position.

Figure 9:
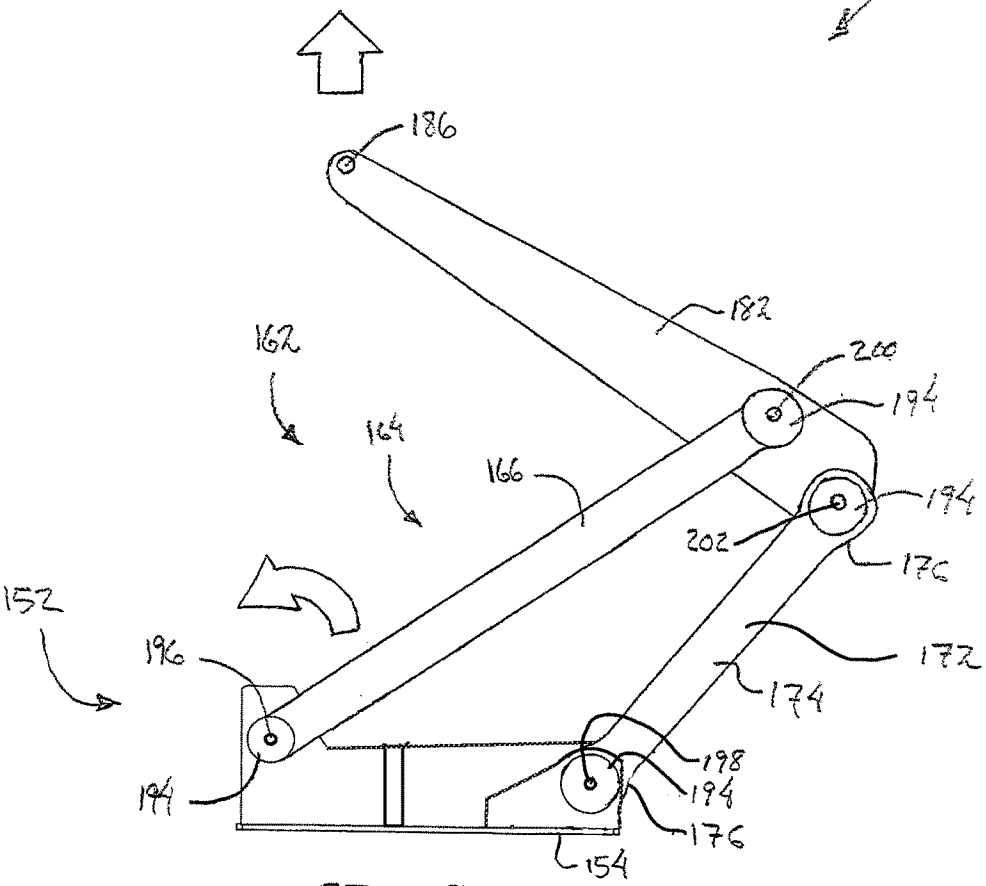
FIG. 9 depicts a side elevational view of the linkage assembly of FIG. 8 with the linkage assembly in an intermediate position.

FIG. 9 shows linkage assembly (160) in an intermediate position which is between the retracted and extended positions of linkage assembly (160). To transition between the retracted position and the intermediate position, pin (200) is forced away from pin (198) via actuation assembly (250) (omitted in FIGS. 7-10 for purposes of clarity). Because linkage assembly (160) is a four bar linkage, forcing pin (198) away from pin (200) causes lower links (162) to simultaneously rotate about pins (196, 198) and pivot third armatures (182) about a point between the center of pins (200, 202). The pivoting action of third armatures (182) causes attachment bores (186) of third armatures (182) to move upwardly. It should be understood that the motion of attachment bores (186) is substantially vertical as lift assembly (150) transitions from the retracted position to the extended position. Of course, the precise path of lift assembly (150) may vary depending on a number of factors such as the length of each armature (164, 172, 182), the relative lengths between armatures (164, 172, 182), or other similar factors.

Figure 10:
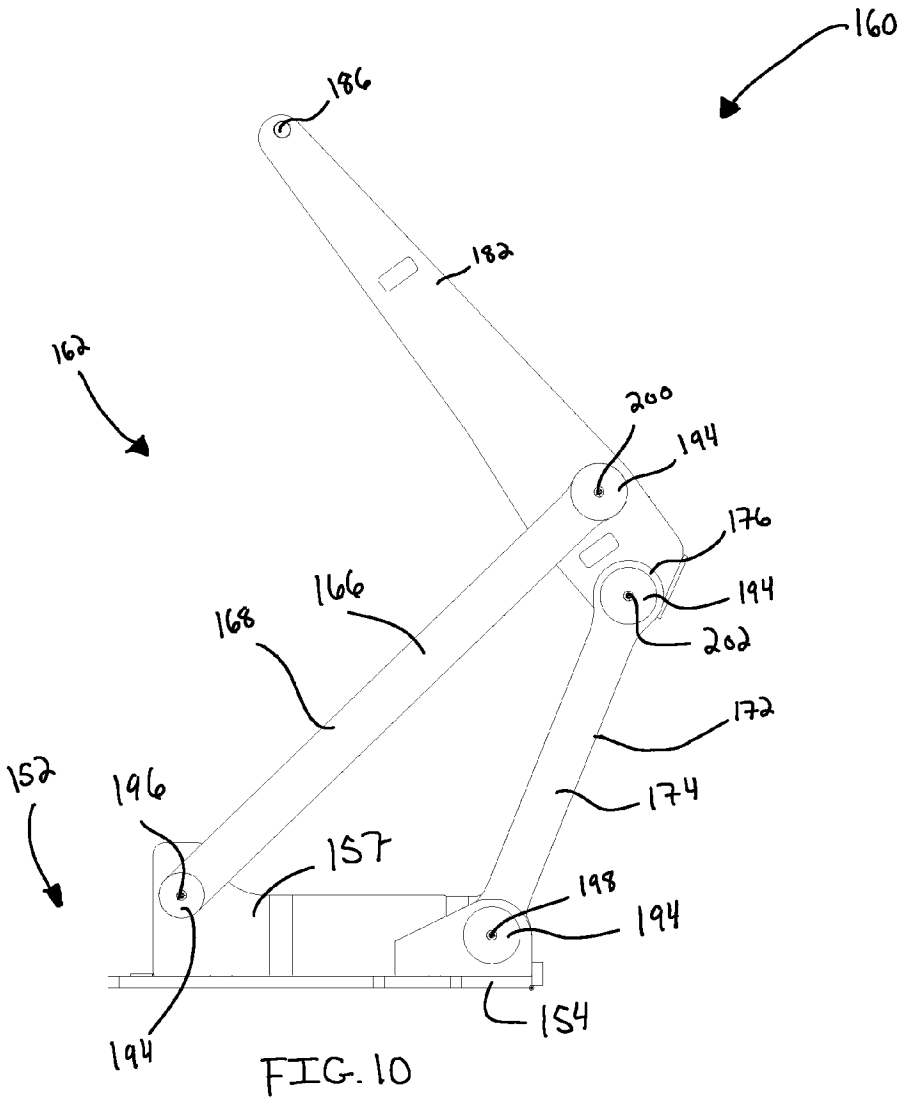
FIG. 10 depicts a side elevational view of the linkage assembly of FIG. 8 with the linkage assembly in an extended position.

FIG. 10 shows linkage assembly (160) in the extended position. As described above, the extended position of linkage assembly (160) corresponds to runway (120) being raised to a desired working height. The operation of transitioning between the intermediate position and the extended position is substantially similar to that of the transition between the retracted position and the intermediate position.

For instance, actuation assembly (250) may continue to apply a force between pin (200) and pin (198), further forcing pins (198, 200) away from each other. Accordingly, lower links (162) further rotate about pins (196, 198) to pivot third armatures (182) about the point between the center of pins (200, 202) to move attachment bore (186) upwardly.

Figure 11:
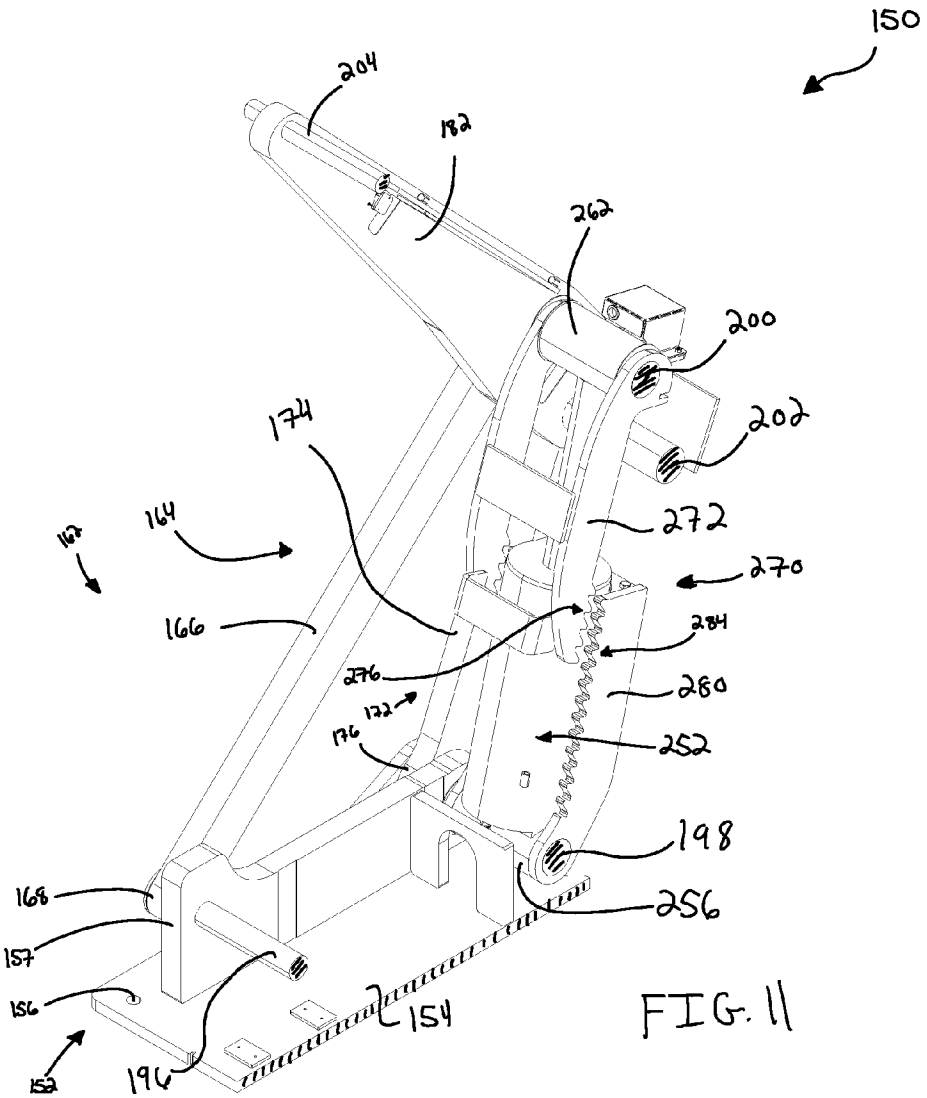
FIG. 11 depicts a cross-sectional perspective view of the lift assembly of FIG. 4 taken along lines 11-11 of FIG. 4.
Figure 12:
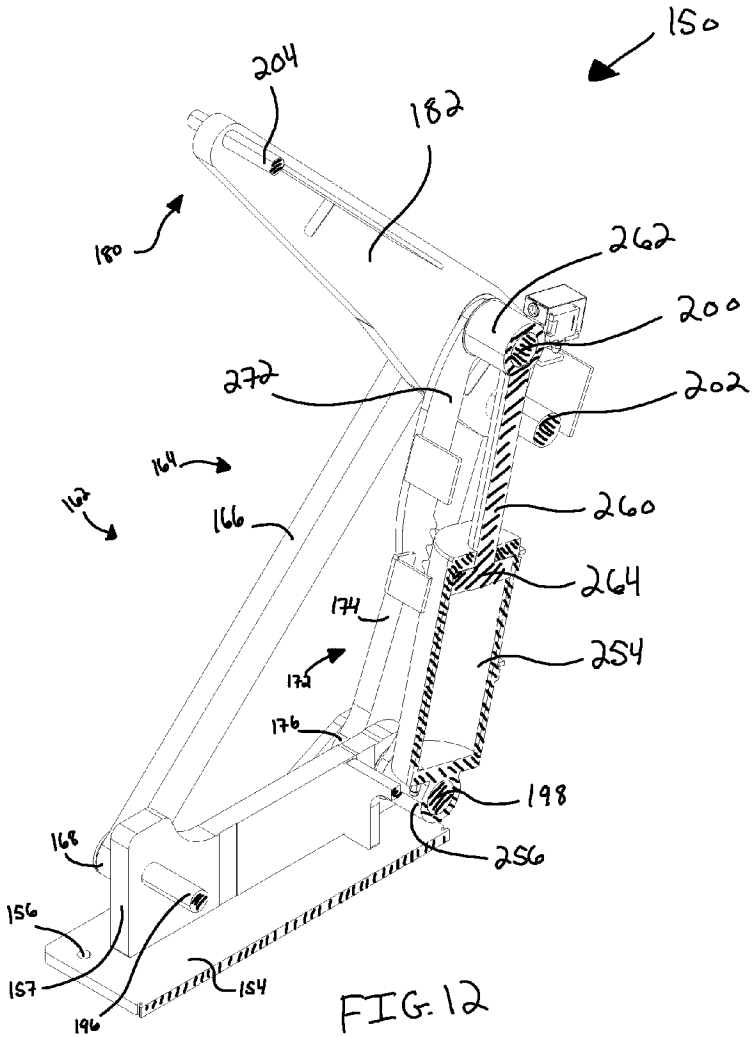
FIG. 12 depicts a cross-sectional perspective view of the lift assembly of FIG. 4 taken along lines 12-12 of FIG. 4.

FIG. 11 shows lift assembly (150) in cross section to fully show actuation assembly (250). Actuation assembly (250) comprises a hydraulic assembly (252) and a lock assembly (270). As can be best seen in FIG. 12, hydraulic assembly (252) comprises a hydraulic cylinder (254) and a hydraulic piston and rod assembly (260). The bottom end of hydraulic cylinder (254) is equipped with a sleeve (256) which is configured to rotatably couple hydraulic cylinder (254) with pin (198). Similarly, the upper end of piston and rod assembly (260) is equipped with sleeve (262) which is configured to rotatably couple piston and rod assembly (260) to pin (200). Although actuation assembly (250) is shown as being hydraulically actuated, it should be understood that any suitable device may be used to actuate lift assembly (150). For instance, actuation assembly (250) may comprise a linear actuator having a lead screw and a motor, a pneumatic actuator, spring loaded actuator, or any other suitable actuator as will be apparent to those of ordinary skill in the art in view of the teachings herein.

Hydraulic cylinder (254) together with piston and rod assembly (260) function similarly to a conventional hydraulic actuator. In particular, hydraulic fluid may be pumped into hydraulic cylinder (254) to force a piston (264) of piston and rod assembly (260) upwardly within hydraulic cylinder (254). Thus, piston and rod assembly (260) may be linearly actuated by hydraulic cylinder (254) via hydraulic fluid pumped into hydraulic cylinder (254). It should be understood that although not depicted herein, hydraulic assembly (252) may comprise other conventional devices and/or elements suitable to operate hydraulic assembly (252) such as valves, pumps, tubes, conduits, sensors, controllers, and/or the like. As with other components described herein, hydraulic assembly (252) may be varied, modified, substituted, or supplemented in a variety of ways. Additionally, hydraulic assembly (252) may have a variety of alternative versions, features, components, configurations, and functionalities. Suitable alternative versions, features, components, configurations, and functionalities of hydraulic assembly (252) will be apparent to those of ordinary skill in the art in view of the teachings herein.

Figure 13:
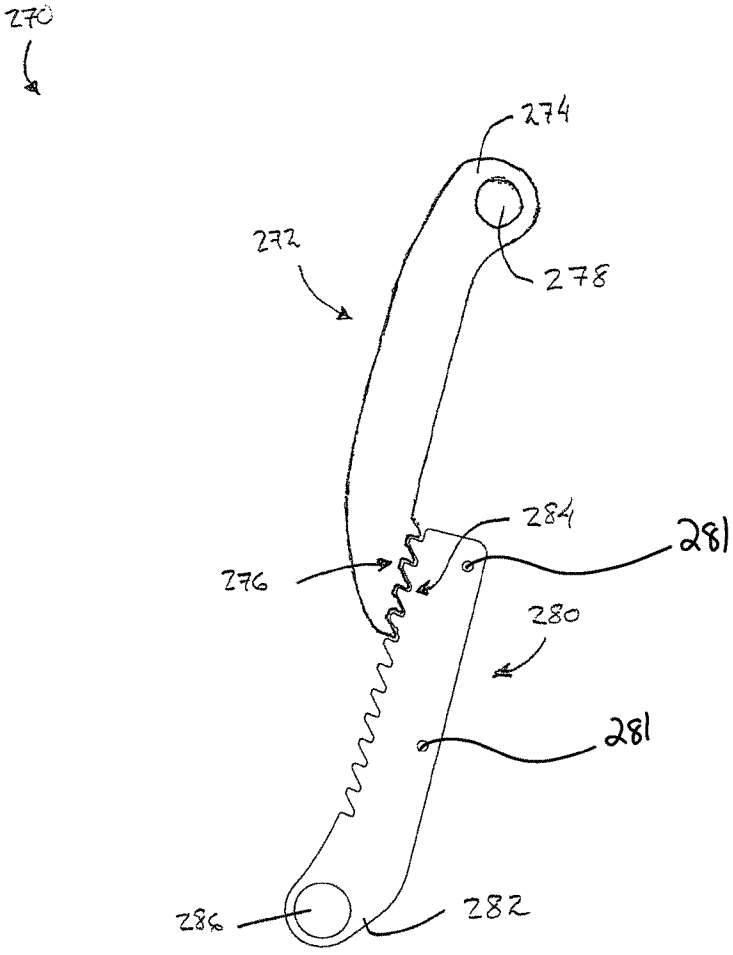
FIG. 13 depicts a side elevational view of lock members of the lift assembly of FIG. 4.

FIG. 13 shows a side elevational view of lock assembly (270). Lock assembly (270) comprises a pair of upper toothed members (272) connected by a metal strips (273, 283) and a pair of lower toothed members (280) fixed to hydraulic cylinder (254). As can be seen, upper toothed member (272) comprises an upper rounded portion (274) and a lower toothed portion (276). Upper rounded portion (274) includes a attachment hole (278), which is configured to rotatably couple to pin (200). Although lock assembly (270) is described as having a certain configuration herein, it should be understood that locking assembly (270) may take on other configurations having various other components. Some non-limiting examples of suitable locking assemblies (270) have previously been described in U.S. Pat. No. 5,190,122, entitled "Safety Interlock System," issued Mar. 2, 1993, the disclosure of which is incorporated by reference herein. Additionally, it should be understood that locking assembly (270) is entirely optional and may be simply omitted.

Lower toothed member (280) is similar to upper toothed member (272), such that the teeth of lower toothed member (280) complement the teeth of upper toothed member (272). Lower toothed member (280) similarly comprises a lower rounded portion (282) and an upper toothed portion (284). Lower rounded portion (282) includes an attachment hole (286) which is configured to rotatably couple to pin (198). Additionally, lower toothed member (280) includes mounting holes (281) configured to mount lower toothed member (280) with hydraulic cylinder (254). Therefore, as hydraulic cylinder (254) transitions from a retracted position to an extended position, lower toothed member (280) follows hydraulic cylinder (254).

Lower toothed portion (276) of upper toothed member (272) and upper toothed portion (284) of lower toothed member (280) correspond to each other such that lower toothed portion (276) and upper toothed portion (284) mate with each other. Each tooth of toothed portions (276, 284) is shaped to unidirectionally engage the corresponding tooth such that upper toothed member (272) ratchets along lower toothed member (280) as lift assembly (150) goes from the retracted position to the extended position. In other words, once toothed portions (276, 284) mate with each other, toothed members (272, 280) can translate in one direction (e.g., upper toothed member (272) can translate upwardly), but not in another direction. Thus, lower toothed member (280) is operable to prevent upper toothed member (272) from translating downwardly relative to lower toothed member (280).

Returning to FIG. 11, in an exemplary mode of operation, actuation assembly (250) is operable to raise, lock, and lower lift assembly (150). As described above, lift assembly (150) is transitioned from the retracted position to the extended position by actuation assembly (250) driving pins (198, 200) away from each other. In the present example, hydraulic assembly (252) is attached to pins (198, 200). Thus, the actuation of hydraulic assembly (252), as described above, is operable to transition lift assembly (150) from a retracted position to an extended position. In other examples, hydraulic assembly (252) need not attach to pins (198, 200). For instance, in some examples, hydraulic assembly (252) may attach to any suitable combination of pins (196, 198, 200, 202). Yet in other examples, hydraulic assembly (252) may not attach to pins (196, 198, 200, 202). Instead, lift assembly (150) may be equipped with brackets specifically configured for mounting hydraulic assembly (252) so that lift assembly (150) may be actuated. Of course, any other suitable configuration whereby hydraulic assembly (252) is attached to lift assembly (150) may be used as will be apparent to those of ordinary skill in the art in view of the teachings herein.

As hydraulic assembly (252) is actuated, lock assembly (270) is operable to lock lift assembly (150) at a given height as lift assembly (150) is raised. In particular, as described above, lock assembly (270) is configured to prevent downward translation of upper toothed member (272) relative to lower toothed member (280). Because upper toothed member (272) is rotatably coupled to pin (200) and lower toothed member (280) is rotatably coupled to pin (198) and fixed to hydraulic cylinder (254), lock assembly (270) is also operable to prevent downward motion of lift assembly (150). Although not shown, it should be understood that lock assembly (270) may further comprise an actuator suitable to move upper toothed member (272) out of engagement with lower toothed member (280). Suitable actuators may include devices such as a solenoid, pneumatic actuator, a motor and lead screw, or the like. Such an actuator may permit lock assembly (270) to be disengaged so that the vehicle lift system (100) may be lowered. Some non-limiting examples of suitable actuators have previously been described in U.S. Pub. No. 2012/0048653, entitled "Multi-Link Automotive Alignment Lift," published Mar. 1, 2012, the disclosure of which is incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should also be understood that the teachings herein may be readily applied to various kinds of lifts. By way of example only, the teachings herein may be readily applied to platform lifts, material lifts, man lifts, etc. The teachings herein may also be readily applied to robotic leg assemblies, adjustable work stations, and shock absorber systems. Various suitable ways in which the teachings herein may be incorporated into such systems and assemblies will be apparent to those of ordinary skill in the art. Similarly, various other kinds of systems and assemblies in which the teachings herein may be incorporated will be apparent to those of ordinary skill in the art.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. An apparatus for lifting vehicles, the apparatus comprising:

(a) a pair of runways together configured to vertically lift a vehicle by transitioning from a lowered position to a raised position, and for each runway:

(b) a third armature assembly comprising a third front end and a third rear end, wherein the third rear end is pivotally coupled to the respective runway;

(c) a base;

(d) a first armature assembly pivotally coupled to the base and the third armature;

(e) a second armature assembly pivotally coupled to the base and the third front end of the third armature assembly; and (f) an actuation assembly pivotally coupled to the base and the third armature, wherein the actuation assembly is configured to actuate the third armature relative to the base thereby transitioning the respective runway from the lowered position to the raised position.

2. The apparatus of claim 1, wherein each base comprises:

(i) a first mounting bracket comprising a first front end pivotally coupled to the second armature assembly and a first rear end pivotally coupled to the first armature assembly, and (ii) a second mounting bracket comprising a second front end and a second rear end.

3. The apparatus of claim 2, wherein each of the first front end of the first mounting bracket, the first rear end of the first mounting bracket, the second front end of the second mounting bracket, and the second rear end of the second mounting bracket comprises a bore.

4. The apparatus of claim 3, wherein the bore of the first front end and the bore of the second front end define a first axis of rotation that the second armature assembly is configured to pivot about, wherein the first rear end and the second rear end define a second axis of rotation that the first armature assembly is configured to pivot about.

5. The apparatus of claim 2, wherein the first armature comprises:

(i) a first link comprising a first end portion and a second end portion, wherein the first end portion is pivotally fixed to the first rear end of the first mounting bracket, wherein the second end portion is pivotally fixed to the third armature assembly, and (ii) a second link comprising a third end portion and a fourth end portion, wherein the third end portion is pivotally fixed to the second rear end of the second mounting bracket, wherein the fourth end portion is pivotally fixed to the third armature assembly.

6. The apparatus of claim 5, wherein the first end portion of the first link and the third end portion of the second link are connected by a first pin, wherein the second end portion of the first link and the fourth end portion of the second link are connected by a second pin.

7. The apparatus of claim 6, wherein the first pin is welded to the base.

8. The apparatus of claim 5, wherein the second end portion of the first link is pivotally fixed to the third armature assembly at a point between the third front end and the third rear end, wherein the fourth end portion of the second link is pivotally fixed to the third armature assembly at a point between the third front end and the third rear end.

9. The apparatus of claim 5, wherein the second armature assembly further comprises:

(i) a third link comprising a fifth end portion and a sixth end portion, wherein the fifth end portion is pivotally fixed to the first front end of the first mounting bracket, wherein the sixth end portion is pivotally fixed to the third armature assembly, and (ii) a fourth link comprising a seventh end portion and an eighth end portion, wherein the seventh end portion is pivotally fixed to the second front end of the second mounting bracket, wherein the eighth end portion is pivotally fixed to the third armature assembly.

10. The apparatus of claim 9, wherein the fifth end portion and the seventh end portion are connected by a third pin, wherein the sixth end portion and the eighth end portion are connected by a fourth pin.

11. The apparatus of claim 10, wherein the fourth pin is welded to the third armature assembly.

12. The apparatus of claim 1, wherein the third rear end of the third armature is configured to move along a substantially vertical path.

13. The apparatus of claim 9, wherein the sixth end portion of the third link is pivotally fixed to the third armature assembly at the third front end, wherein the eighth end portion is pivotally fixed to the third armature assembly at the third front end.

14. The apparatus of claim 1 further comprising a locking assembly configured to support the vehicle and to selectively maintain a position of the runway relative to the base without assistance from the actuation assembly.

15. The apparatus of claim 14, wherein the locking assembly further comprises an upper toothed member and a lower toothed member.

16. The apparatus of claim 15, wherein the upper toothed member is configured to pivot relative to the third armature assembly, wherein the lower toothed member is configured to pivot relative to the base.

17. An apparatus for lifting vehicles, the apparatus comprising a pair of vehicle engagement assemblies configured to vertically lift a vehicle together, wherein each vehicle engagement assembly comprises:

(a) an elongated runway; and (b) a lift assembly configured to support the vehicle via the respective vehicle engagement assembly while vertically lifting the vehicle, wherein the lift assembly comprises a first actuation assembly and a second actuation assembly associated with the elongated runway, wherein the first actuation assembly comprises:

(i) a third armature assembly comprising a third front end and a third rear end, wherein the third rear end is pivotally fixed to the first runway, (ii) a base comprising a first front end and a first rear end, (iii) a first armature assembly pivotally fixed to the first rear end of the base and the third armature, (iv) a second armature assembly pivotally fixed to first front end of the base and the third front end of the third armature assembly, and (v) an actuator pivotally fixed to the base and the third armature assembly.

18. The apparatus of claim 17, wherein the first front end of the base comprises a first pair of mounting brackets defining a first axis of rotation about which the second armature assembly is pivotally fixed to the first front end of the base, wherein the first rear end of the base comprises a second pair of mounting brackets defining a second axis of rotation about which the first armature assembly is pivotally fixed to the first rear end of the base.

19. The apparatus of claim 18, wherein the first axis of rotation is located at a vertical height below the second axis of rotation.

20. An apparatus for lifting vehicles, the apparatus comprising:

(a) a pair of runways together configured to vertically lift a vehicle by transitioning from a lowered position to a raised position, and for each runway:

(b) a third armature assembly comprising a third front end and a third rear end;

(c) a base fixed to the respective runway;

(d) a first armature assembly comprising a first link and a second link, wherein the first link and the second link are pivotally fixed to the base and the third armature;

(e) a second armature assembly comprising a third link and a fourth link, wherein the third link and the fourth link are pivotally fixed to the base and the third front end of the third armature assembly; and (f) an actuation assembly pivotally fixed to the base and the third armature assembly, wherein the actuation assembly is located between the third link and the fourth link, wherein the actuation assembly is configured to support the vehicle via the respective runway and to raise the respective runway relative to the base thereby transitioning the respective runway from the lowered position to the raised position.

* * * * *